US011523967B2

(12) United States Patent
Stemple

(10) Patent No.: US 11,523,967 B2
(45) Date of Patent: Dec. 13, 2022

(54) DEVICE FOR CARDIOPULMONARY MASSAGE AND/OR RESUSCITATION

(71) Applicant: GS ELEKTROMEDIZINISCHE GERÄTE G. STEMPLE GMBH, Kaufering (DE)

(72) Inventor: Günter Stemple, Kaufering (DE)

(73) Assignee: GS Elektromedizinische Geräte G. Stemple GmbH, Kaufering (DE)

( * ) Notice: Subject to any disclaimer, the term of this patent is extended or adjusted under 35 U.S.C. 154(b) by 1126 days.

(21) Appl. No.: 15/777,356

(22) PCT Filed: Feb. 15, 2017

(86) PCT No.: PCT/IB2017/050838
§ 371 (c)(1),
(2) Date: May 18, 2018

(87) PCT Pub. No.: WO2017/158451
PCT Pub. Date: Sep. 21, 2017

(65) Prior Publication Data

US 2021/0196564 A1 Jul. 1, 2021

(30) Foreign Application Priority Data

Mar. 14, 2016 (DE) ..... 10 2016 104 679.5

(51) Int. Cl.
*A61H 31/00* (2006.01)

(52) U.S. Cl.
CPC ..... *A61H 31/006* (2013.01); *A61H 31/008* (2013.01); *A61H 2201/1621* (2013.01)

(58) Field of Classification Search
CPC ..... A61H 31/006; A61H 31/008
See application file for complete search history.

(56) References Cited

U.S. PATENT DOCUMENTS 3,351,052 A 11/1967 Hewson
3,511,275 A 5/1970 Hewson
(Continued)

FOREIGN PATENT DOCUMENTS

CN 2013-56780 Y 12/2009
DE 14 91 745 10/1969
(Continued)

OTHER PUBLICATIONS

International Search Report dated Mar. 31, 2017.

*Primary Examiner* — LaToya M Louis
(74) *Attorney, Agent, or Firm* — Fay Sharpe LLP

(57) ABSTRACT

A device for cardiopulmonary massage and/or resuscitation of a patient, which has a massage device arranged on a support board and includes a reversibly drivable massage stamp that can be positioned at a desired contact area on the thoracic cage of the patient for performing cardiopulmonary massage, and further includes a retention plate element which can be positioned on the thoracic cage of the patient at the desired contact area and which, by using at least three clamping elements engaging on its circumference, can be fixed, in particular can be connected to and braced by the support board. This has the effect that the mechanical cardiopulmonary massage can be maintained upright even during difficult transport maneuvers, since the relative position of the patient with respect to the massage device is not appreciably changed by its being clamped between the support board and the retention plate element.

9 Claims, 3 Drawing Sheets

(56) References Cited

U.S. PATENT DOCUMENTS

| | | | | |
|---|---|---|---|---|
| 3,985,126 | A | 10/1976 | Barkalow | |
| 4,060,079 | A | 11/1977 | Reinhold, Jr. | |
| 4,632,094 | A | 12/1986 | Thomas | |
| 4,915,095 | A * | 4/1990 | Chun | A61H 31/007 601/43 |
| 5,211,186 | A * | 5/1993 | Shoemaker | A61F 5/05883 128/869 |
| 5,634,222 | A * | 6/1997 | Zwickey | A61G 1/04 128/845 |
| 10,092,464 | B2 * | 10/2018 | Ehrstedt | A61H 31/006 |
| 2001/0011159 | A1 * | 8/2001 | Cantrell | A61M 16/0084 601/41 |
| 2003/0135139 | A1 | 7/2003 | Bassuk et al. | |
| 2005/0015026 | A1 | 1/2005 | Well et al. | |
| 2009/0187127 | A1 * | 7/2009 | Buckman | A61F 5/05816 602/13 |
| 2015/0313778 | A1 * | 11/2015 | Chia | A61G 1/044 128/876 |
| 2015/0366751 | A1 | 12/2015 | Stemple | |

FOREIGN PATENT DOCUMENTS

| | | | |
|---|---|---|---|
| DE | 10 2013 100 943 | | 7/2014 |
| DE | 2015 001616 | | 3/2016 |
| JP | 2009-39208 | A | 2/2009 |
| JP | 2015-139595 | A | 8/2015 |

* cited by examiner

DEVICE FOR CARDIOPULMONARY MASSAGE AND/OR RESUSCITATION

BACKGROUND

The invention relates to a device for cardiopulmonary massage and/or resuscitation of a patient, with a massage device which is located or locatable at a support board and which is provided with a reversibly drivable massage stamp that can be positioned at a desired contact area on the thoracic cage of the patient to carry out cardiopulmonary massage.

A device of this kind is known from DE 10 2013 100 943 A1. In the known device, the massage device can be driven reversibly from a drive direction to an actuation direction and has a contact surface on its pressure stamp that can be positioned at a desired contact area on a patient's thoracic cage. Deviations in the position of the contact area of the massage device from a desired area are determined by a position sensor device, with which it is possible to determine changes in the position of the massage device and/or its contact area in relation to the desired contact area on the patient's thoracic cage in a plane normal for the actuation direction of the massage device.

The known device, in which connecting the massage device on the support board initiates the pressure forces exerted by the massage stamp while cardiac massage is being administered directly into the support board, on which the patient is lying, is well suited to conduct cardiac massage mechanically on a patient, provided that the device is largely stationary and the position of the device in relation to the substrate, for example a stretcher permanently installed in an ambulance, does not change, or does not change appreciably. However, paramedics often have the problem that they initially have to transport a patient from a home or the site of an accident with suitable carrying aids to an ambulance or helicopter, where it can be the case that cardiac massage must not be interrupted during this transport process. Although the known device is definitely capable of continuing the massage with the pressure stamp while the patient is being transported, for example on a stretcher or a sling, in such transport processes it can easily be the case that the patient lying on the support board changes his position in relation to it—possibly very suddenly. In practice, when transporting the patient on a staircase, for example, this means that a more-or-less continuous operation of the massage device is not possible because there are changes in the position of the massage device in relation to the desired contact area on the patient's thoracic cage that are too quick and too big and efficient resuscitation is thus not possible. It may even put the patient at risk.

From DE 14 91 745 A, a device to stimulate and resuscitate a patient's heart and lung activity is known that has a massage unit, that is connected with straps to a shoulder support that is similar to a support board; these straps keep the massage unit firm on the chest of the patient lying on the shoulder support. In this device the holding forces, which occur as reaction forces during cardiac massage, are transmitted to the shoulder support via the straps, which results in very high holding forces in the straps due to the position of the straps not being exactly the same as the actuation direction of the massage unit. Nevertheless, every time the massage unit is pressed onto the patient's thoracic cage, the massage unit lifts slightly from the thoracic cage, which reduces the effectiveness of the cardiac massage. The situation with the transport device for a patient known from U.S. Pat. No. 4,060,079 is not much different; with this device the patient can be given a cardiac massage during transport with a massage device fastened with straps. And in the arrangement known from U.S. Pat. No. 4,915,095, a cardiac massage unit is attached to the patient's thoracic cage using straps that are wrapped around the patient's upper body and absorb the thrusting force when the pressure stamp moves down.

BRIEF DESCRIPTION

It is the object of the invention to improve a device of the type mentioned at the outset so that mechanical cardiopulmonary massage can be maintained during the difficult transport actions explained.

With the invention; this object is solved by a retention plate element that can be positioned on the desired contact area of patient's thoracic cage, which retention plate can be fixed by at least three clamping elements engaging on its circumference, whereat at least two of the three clamping elements can be connected to and braced with the support board.

The retention plate element according to the invention allows the patient to be reliably fixed between it and the support board so that even during difficult carrying, for example the patient being carried down a staircase, the position of the patient's thoracic cage does not change in relation to the support board, at least not dramatically, so that the massage device connected to the support board retains its position on the desired contact area and can continue to perform its massage task during transport. The patient is effectively clamped with his upper body between the support board and the retention plate element by means of the clamping elements operating between these two components of the emergency system so that he cannot slip significantly in relation to the support board, as a result of which the desired point of application for the massage device for correctly carrying out cardiac massage would change.

The retention plate element is preferably provided with fastening straps positioned on its circumference, on which the clamping elements can be connected in a way that is detachable. This design enables the device to be applied quickly and precisely to the patient by laying the patient on the support board and then placing the retention plate element on his thoracic cage, in order to subsequently connect the clamping elements to the fastening straps, the ends of which can be connected firmly to the support board or also (at least partially) to a sling or stretcher carrying the support board. All that remains to fix the patient between the support board and the retention plate element is to tighten the clamping elements.

The retention plate element can either be circular with a central contact surface for the massage stamp or, in a particularly preferred design, ring-shaped with a central opening for the passage of the massage stamp. If the retention plate element is circular with a closed central contact area, it is aligned on the patient's thoracic cage so that it is as exactly as possible over the desired contact area for the massage device. The pressure stamp of the massage device is then on the upper side of the contact area of the retention plate element. In this way, it is also possible to fix the set position of the contact area of the massage device in relation to the contact area on the retention plate element by means of a locking device between these two areas, for example by means of a Velcro fastener with fleece on one of the areas and a Velcro element on the other area. If, as is usually the case, it is preferred that the desired contact area on the sternum remains accessible, in particular visible, for the doctors or paramedics during cardiac massage in order to allow a visual control of the correct position of the stamp, this is possible without any problems with the ring-shaped design of the retention plate element, through the ring-shaped opening through which the massage stamp can be placed on the patient's sternum.

In a beneficial further development of the invention, the retention plate element has four connecting elements arranged, preferably evenly, on its circumference for four clamping elements engaging on the corner areas of the support board. It is particularly beneficial if the retention element has an additional connection for an additional clamping element between the patient's legs. Such an additional clamping element, fed between the patient's legs, the other end of which can either also be connected to the support board or to a sling, stretcher or other carrying system, if this is being used, also guarantees, even when the patient is heavily tilted, which can happen when being transported on stairs, that the patient is held securely, and that he can then not slip notably in relation to the support board. Furthermore, in connection with the sling or another carrying system, slipping of the system comprising patient, support board with retention plate element and massage device in relation to the sling or other carrying element is prevented.

In a beneficial design of the invention the clamping elements are securing straps with hook fastening elements that can be connected to the connecting elements on the retention plate element in such a way that they can be detached. It is especially beneficial if the hook fastening elements engage in the associated connecting elements with magnetic support.

For practical reasons, the retention plate element is at least largely inflexible in the radial and/or circumferential direction and in a direction vertical to the patient's thoracic cage is malleable. As a result, it can readily absorb the clamping forces exerted by the clamping elements on the retention plate element largely in the radial direction on the one hand, and adjust itself well to the anatomical shape of the patient's thoracic cage on the other hand. For example, the retention plate element can have a central ring or disc element made of elastic plastic material, that is preferable covered with a high-strength fabric on which the connecting elements are provided.

The connecting elements and/or the additional connection can be located at fastening straps that are arranged at the retention plate element in a roughly radially projecting manner.

If it is desired to use the device according to the invention in combination with a sling in such a way that the support board is placed on the upper side of the sling, the arrangement should preferably be so that at least one of the clamping elements engaging on the retention plate element is connected to the sling, or can be connected to it. It is especially preferred for the clamping element that is connected can be connected to the sling to be the additional clamping element that can be guided between the patient's legs and connected to the additional connection.

BRIEF DESCRIPTION OF THE DRAWINGS

Further features and advantages of the invention result from the description below and the drawing, where a preferred design of the invention is described in more detail using an example. It shows.

DETAILED DESCRIPTION

Figure 1:
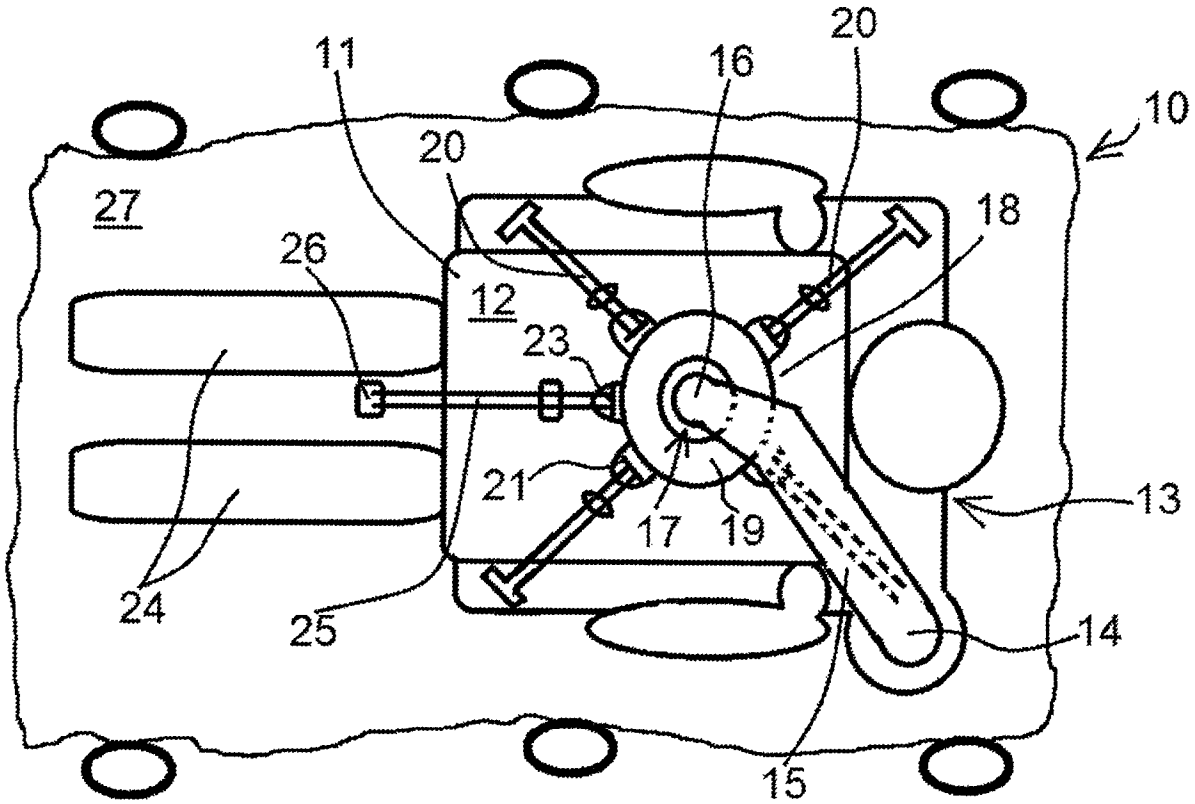
FIG. 1 a device according to the invention with a patient in a schematically simplified top view.

FIG. 1 shows an entire device according to the invention, labelled with 10, with the help of which a patient 11 can be transported in a lying position while simultaneously receiving cardiac massage. For this purpose, the device 10 is provided with a support board 12 on which the patient lies on his back. At the support board 12 in one of the corner areas located at the head end 13, a massage device 14 is arranged having, on a portal support that cannot be clearly seen in a top view according to FIG. 1, an arm 15 projecting above the patient's chest, which carries a reversibly drivable massage stamp 16 at its free end. The massage stamp 16 can be positioned at a desired contact area 17 to carry out the cardiopulmonary massage on the patient 11 by moving its pressure head up and down. The reaction forces, which mainly impact vertically to the patient's chest and that occur as a consequence of cardiac massage, are directly taken up by the massage device 14 into the support board 12 to which it is directly connected. As far as it is described until now, the structure of the device broadly corresponds to the one known from DE 10 2013 100 943 A1, which is incorporated by reference herewith and the disclosure of which is hereby made the subject of this application.

According to the invention, a retention plate element 19 that can be positioned at the desired contact area 17 at the thoracic cage 18 of the patient 11, which has four clamping elements 20 engaging on its circumference that can be connected to and braced in the corner areas of the support board 12. For this purpose, the retention plate element 19 features four connecting elements 21, which are arranged roughly evenly and diagonally opposite each other and are aligned to the corner areas of the support board 12 where the four clamping elements 20 fastened to the corner areas of the support board can engage. The clamping elements 20 are securing straps that have hook fastening elements 22 that can be attached to the connecting elements 21 assigned to the retention plate element 19 in a detachable manner. In order to ease the connection of the hook fastening elements 22 to the associated connecting elements 21, it is preferably provided that the hook fastening elements engage with the relevant connecting elements with magnetic support.

In FIG. 1 it can be seen that the retention plate element 19 has an additional connection 23 for an additional clamping element 25 guided between the legs 24 of the patient 11, the other end 26 of which is permanently sewn to a sling 27 on which the support board 12 is lying and with the help of which, the patient 11 can be carried by the emergency services over difficult terrain, such as a narrow stairwell.

The arrangement according to the invention enables the patient 11 to largely maintain a consistent position in relation to the massage device 14 even during transport, in that the patient's upper body is firmly clamped between the support board 12 and the retention plate element 19 by means of clamping elements 20 operating firmly between these two parts of the device, so that he cannot slip, at least not appreciably, while he is being transported. The massage device can therefore carry out cardiac massage during transport, without the risk that the massage stamp 16 loses is position at the desired contact area (i.e. on the patient's sternum). The additional connection 23 with the additional clamping element 25 guided between the patient's legs 24, which is directly connected to the sling 27, ensures that the patient's position in relation to the sling remains largely the same and, in particular, the patient with the device placed on his upper body cannot slip forwards (e.g. left in FIG. 1) out of the sling, for example if the patient is carried feet first down a staircase by the emergency services.

Figure 2:
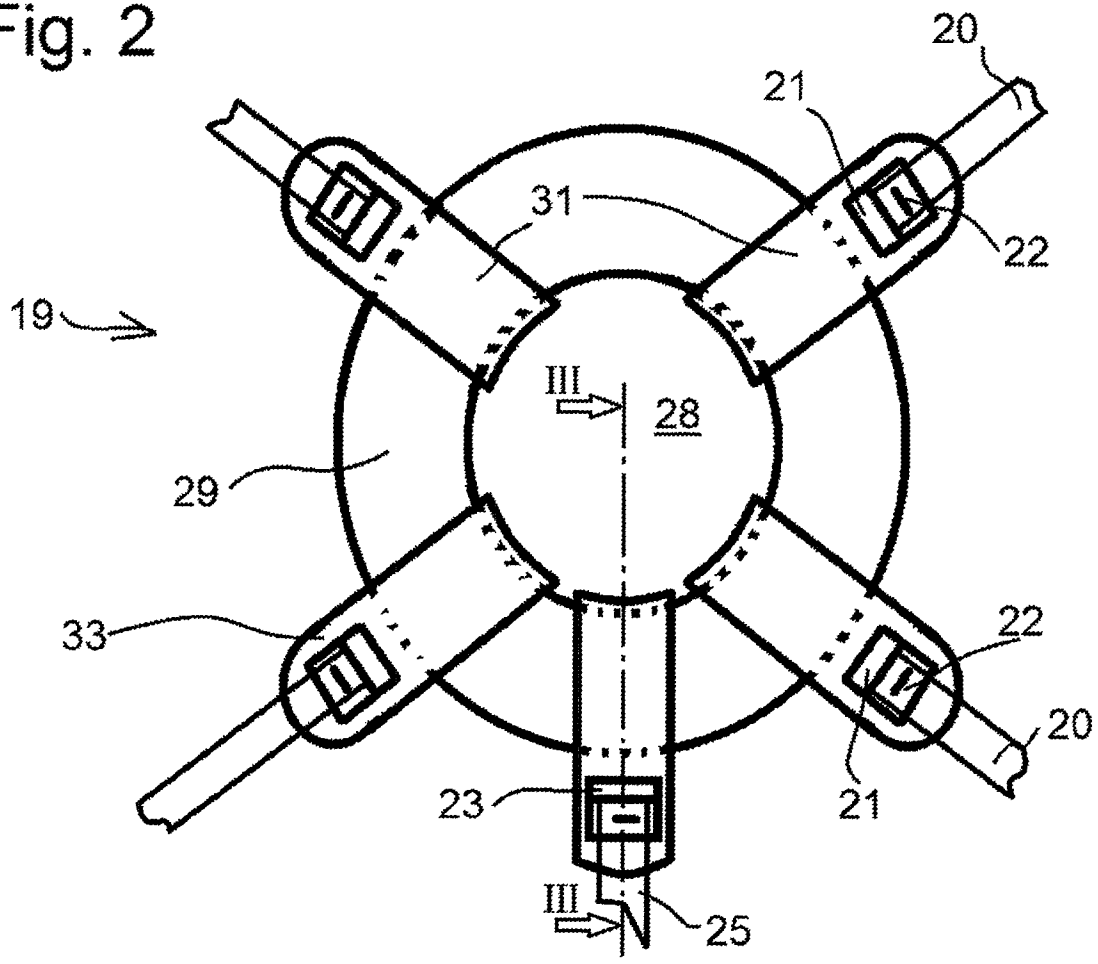
FIG. 2 a preferred design of the retention plate element used in the device according to FIG. 1 in a top view.
Figure 3:
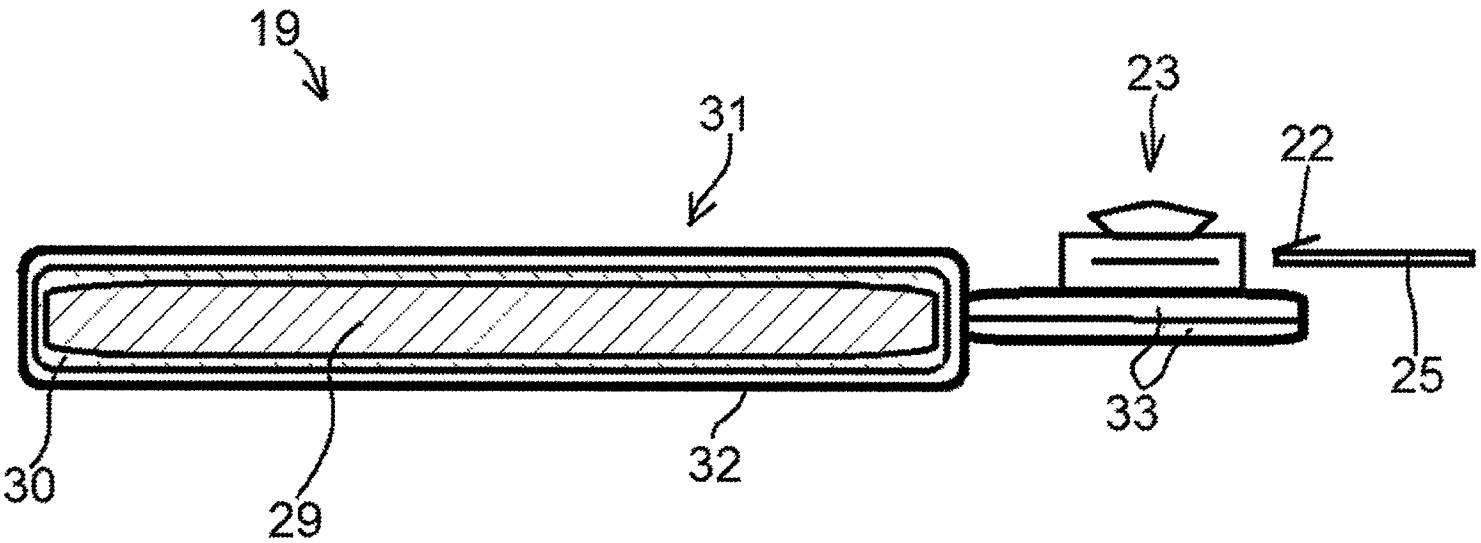
FIG. 3 the subject of FIG. 2 is a cross section along the line III-III.

The retention plate element 19 is shown in more detail in FIGS. 2 and 3. As can be seen, the preferred design shown is ring-shaped with a central opening 28, which forms access for the massage stamp 16 when the retention plate element 19 is positioned at the desired contact area 17 of the patient, i.e. preferably concentric to the lower third of the sternum of the thoracic cage 18. The retention plate element 19 has an inner ring element 29 made of an elastic plastic material that is around 2 to 5 mm thick, which is covered with a high-strength fabric. Due to the comparatively large width of the ring element 29 in its radial direction, which is preferably at least 35 mm and at least 50 mm in the design shown, the retention plate element is largely inflexible in its radial direction and in its circumferential direction whereas it is malleable in a direction vertical to the patient's thoracic cage due to the comparatively low thickness, so that is can adapt to the individual anatomical conditions of the patient concerned. In the design example described and shown here, the connecting elements 21 and the additional connection 23 are located on fastening straps 31 which project radially from the retention plate element 19. For this, the fastening straps 31 comprise strips 32 made of a high-strength fabric that are wrapped around the clamped ring element 29 and whose radially protruding ends 33 are sewn together and to the connecting elements 21 or the additional connection 23 or connected in another, suitable way.

The ring-shaped design of the retention plate element 19 with the central opening 28 makes positioning of the massage stamp for cardiac massage easier, by initially ensuring that the retention plate element is correctly positioned on the patient's thoracic cage and then firmly connected with the support board 12 below the patient with the help of the clamping elements 20, so that it can no longer shift to the side and firmly clamps the patient's thoracic cage between itself and the support board. It is possible to mark the ring element 29 with marking strips (not shown), for example in the area of the four fastening straps offset against each other by 90° for the clamping elements 20 to be connected to the support board or between them, which marking strips ease the correct alignment of the retention plate element concentric to the desired contact area 17, which coincides with the centre of the central opening 28, i.e. concentric to the opening 28. After correct application of the retention plate element, all that remains is for the massage stamp 16 to be positioned with its contact area centrally in the central opening 28 of the ring element 29. But it is also possible to design the retention plate element not as a ring, but closed and the contact area of the massage stamp is then placed not directly on the patient's chest, but on the upper side of the retention plate element, which freely joins in the up and down movement of the massage stamp vertically to the patient's thoracic cage due to its inherent flexibility. In such a design, it is also possible to couple the contact area of the massage stamp to the retention plate element, for example using a Velcro fastener, and in this way create a fixed connection between the massage stamp and the patient secured by the device in a direction transverse to the actuation direction of the massage stamp.

The invention claimed is:

1. A device for cardiopulmonary massage and/or resuscitation of a patient, comprising:

a support board on which a patient is able to rest on his back during use;

a massage device arranged directly connected at the support board, said massage device comprising:

a portal support;

a cantilever arranged on the portal support and configured to project above the patient's chest; and a reversibly drivable massage stamp arranged at the free end of the cantilever, wherein the massage stamp can be positioned at a desired contact area on the thoracic cage of the patient for performing cardiopulmonary massage, said device further comprising a retention plate element which can be positioned at the thoracic cage of the patient at the desired contact area, and at least three clamping elements engaging on the circumference of the retention plate element, whereat the retention plate element can be connected to and braced with the support board with the at least three clamping elements engaging on the circumference thereof, so that the patient can be fixed with his upper body between the support board and the retention plate element with the clamping elements acting between them, and whereat the retention plate element has either a circular design with a central contact surface for the massage stamp or is ring-shaped with a central opening for the passage of the massage stamp, wherein the retention plate element has a central ring or disc element made out of elastic plastic material that is covered with a high-strength fabric, at which connecting elements are provided.

2. The device according to claim 1 in combination with a sling for carrying the patient, said support board being arranged on said sling, whereat at least one of the clamping elements engaging with the retention plate element is connected to, or can be connected to, the sling.

3. The device according to claim 1, wherein the retention plate element is provided with fastening straps positioned on its circumference, onto which the clamping elements can be connected.

4. The device according to claim 1, wherein the clamping elements are four clamping elements, and the retention plate element has four of the connecting elements arranged on its circumference for said four clamping elements engaging at corner areas of the support board.

5. The device according to claim 4, wherein the connecting elements are located on fastening straps that are arranged at the retention plate element in a roughly radially projecting manner.

6. The device according to claim 1, wherein the retention plate element has an additional connection for an additional clamping element that can be guided between the patient's legs.

7. The device according to claim 1, wherein the clamping elements are securing straps with hook fasteners that can be attached detachably to the connecting elements located on the retention plate element.

8. The device according to claim 7, wherein the hook fasteners engage in respective ones of the connecting elements with the assistance of magnets.

9. The device according to claim 1, wherein the retention plate element is designed to be at least largely inflexible in the radial and/or circumferential direction, whereas it is malleable in a direction vertical to the patient's thoracic cage in use.

* * * * *